US006478199B1

(12) United States Patent
Shanklin et al.

(10) Patent No.: US 6,478,199 B1
(45) Date of Patent: Nov. 12, 2002

(54) AUTOMATIC VALVE

(75) Inventors: Donald J. Shanklin, Riverside, CA (US); Nathan R. Westphal, Racine, WI (US); Thomas Jaworski, Racine, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 10/056,349

(22) Filed: Jan. 24, 2002

(51) Int. Cl.[7] ..... B65D 83/00

(52) U.S. Cl. ..... 222/402.22; 222/207; 222/449; 239/101; 239/533.15

(58) Field of Search ..... 222/207, 402.2, 222/449; 239/101, 337, 533.15

(56) References Cited

U.S. PATENT DOCUMENTS 3,185,356 A * 5/1965 Venus, Jr. ..... 222/402.2
3,477,613 A 11/1969 Mangel
3,658,209 A 4/1972 Freeman et al.
4,077,542 A 3/1978 Petterson
4,396,152 A 8/1983 Abplanalp
5,018,963 A 5/1991 Diederich
6,145,712 A * 11/2000 Benoist ..... 222/402.2
6,216,925 B1 4/2001 Garon ..... 222/645

FOREIGN PATENT DOCUMENTS

EP 826608 A1 3/1998

* cited by examiner

*Primary Examiner*—Philippe Derakshani

(57) ABSTRACT

A dispenser can automatically dispense chemical from an aerosol container at predetermined intervals without the use of electric power. A diaphragm at least partially defines an accumulation chamber that receives chemical from the can during an accumulation phase. Once the internal pressure of the accumulation chamber reaches a predetermined threshold, the diaphragm moves, carrying with it valving that controls a spray burst. The diaphragm assumes its original position when the pressure within the accumulation chamber falls below a threshold pressure. A barrier prevents the aerosol container from resupplying the accumulation chamber at a high rate during the spray phase, preferably due to a porous gasket disposed in a passageway linking the dispenser to the aerosol container.

10 Claims, 8 Drawing Sheets

AUTOMATIC VALVE

BACKGROUND OF THE INVENTION

The present invention relates to aerosol dispensing devices, and in particular to valve assemblies that provide automatic dispensing of chemical at predetermined time intervals, without requiring the use of electrical power.

Aerosol cans dispense a variety of ingredients. Typically, an active is mixed with a propellant which may be gaseous, liquid or a mixture of both (e.g. a propane/butane mix; carbon dioxide), and the mixture is stored under pressure in the aerosol can. The active mixture is then sprayed by pushing down/sideways on an activator button at the top of the can that controls a release valve. For purposes of this application, the term "chemical" is used to mean liquid, liquid/gas, and/or gas content of the container (regardless of whether in emulsion state, single homogeneous phase, or multiple phase).

The pressure on the button is typically supplied by finger pressure. However, for fragrances, deodorizers, insecticides, and certain other actives which are sprayed directly into the air, it is sometimes desirable to periodically refresh the concentration of active in the air. While this can be done manually, there are situations where this is inconvenient. For example, when an insect repellant is being sprayed to protect a room overnight (instead of using a burnable mosquito coil), the consumer will not want to wake up in the middle of the night just to manually spray more repellant.

There a number of prior art systems for automatically distributing actives into the air at intermittent times. Most of these rely in some way on electrical power to activate or control the dispensing. Where electric power is required, the cost of the dispenser can be unnecessarily increased. Moreover, for some applications power requirements are so high that battery power is impractical. Where that is the case, the device can only be used where linkage to conventional power sources is possible.

Other systems discharge active intermittently and automatically from an aerosol can, without using electrical power. For example, U.S. Pat. No. 4,077,542 relies on a biased diaphragm to control bursts of aerosol gas at periodic intervals. See also U.S. Pat. Nos. 3,477,613 and 3,658,209.

However, biased diaphragm systems have suffered from reliability problems (e.g. clogging, leakage, uneven delivery). Moreover, they sometimes do not securely attach to the aerosol can.

Also, in some cases it is desirable to greatly restrict and carefully control the amount of aerosol being sprayed with each burst. Many of the systems developed to date do not adequately meet this need.

Thus, a need still exists for improved automated aerosol dispensers that do not require electrical power.

BRIEF SUMMARY OF THE INVENTION

In one aspect the invention provides a dispenser that is suitable to dispense a chemical from an aerosol container. The dispenser is of the type that can automatically iterate between an accumulation phase where the chemical is received from the container, and a spray phase where the received chemical is automatically dispensed at intervals.

The dispenser has a housing mountable on an aerosol container, a movable diaphragm associated with the housing, the diaphragm being biased towards a first configuration, an accumulation chamber inside the housing for providing variable pressure against the diaphragm; and valving operable in response to movement of the diaphragm for controlling flow of the chemical from the aerosol container to the accumulation chamber, and from the accumulation chamber out the dispenser.

When the diaphragm is in the first configuration spray of the chemical out of the dispenser is prevented while flow of the chemical from the aerosol container to the accumulation chamber is permitted. When the pressure of chemical inside the accumulation chamber exceeds a specified threshold the diaphragm can move to a second configuration where chemical is permitted to spray from the dispenser.

There are four primary preferred embodiments. In a first of these, a first valve element is linked to the diaphragm to axially move therewith and control flow from the accumulation chamber out the dispenser via a first outlet path. There is also a second valve element that is linked to the diaphragm to axially move therewith and control flow from the aerosol container out the dispenser via a second outlet path that is separate from the first.

In a second of these a first valve element is linked to the diaphragm to axially move therewith and control direct flow from the aerosol container out the dispenser via a first outlet path. There is also a second valve element that is mounted adjacent the diaphragm to contact the diaphragm in the first configuration and not contact the diaphragm in the second configuration, the second valve element controlling flow from the accumulation chamber to the first outlet path.

In a third of these, a first valve element is linked to the diaphragm to axially move therewith and control flow from the accumulation chamber out the dispenser via a first outlet path. In this form, all chemical exiting the dispenser must pass through the accumulation chamber to exit the dispenser. This restricts each burst to a very small, consistent, controlled amount.

In the fourth of these, a first valve element is linked to the diaphragm to move therewith and control flow from the accumulation chamber out the dispenser via an outlet path. The chemical in the accumulation chamber exerts pressure against the diaphragm by exerting pressure against an intermediate transverse shuttle on which the first valve element is positioned.

Still other preferred forms of the invention provide a diaphragm that will shift back to the first configuration from the second configuration when pressure of the chemical in the accumulation chamber falls below a threshold amount. Typically, such a container is linked to the housing, and there is an actuator portion of the housing that rotates to allow chemical to be able to leave the container.

Alternatively, chemical flowing from the accumulation chamber can merge with chemical flowing from the aerosol container prior to exiting the dispenser, or can exit the dispenser as a separate stream from the chemical flowing directly out the dispenser from the aerosol container, when the diaphragm is in the second configuration.

Methods for using these dispensers with aerosol containers are also disclosed.

The present invention achieves a secure mounting of a dispensing valve assembly on an aerosol can, yet provides an actuator that has two modes. In one mode the valve assembly is operationally disconnected from the actuator valve of the aerosol container (a mode suitable for shipment or long-term storage). Another mode operationally links the valve assembly to the aerosol container interior, and begins the cycle of periodic and automatic dispensing of chemical there from. Importantly, periodic operation is achieved without requiring the use of electrical power to motivate or control the valve.

The valve assembly has few parts, and is inexpensive to manufacture and assemble. Further, it is self-cleaning to help avoid clogs and/or inconsistent bursts. Moreover, certain of these embodiments provide an extra degree of control over the volume of burst delivered in each spray. Others provide an extra degree of control by separating accumulation chamber pressures from a separate aerosol can outlet flow.

The foregoing and other advantages of the invention will appear from the following description. In the description reference is made to the accompanying drawings which form a part thereof, and in which there is shown by way of illustration, and not limitation, preferred embodiments of the invention. Such embodiments do not necessarily represent the full scope of the invention, and reference must therefore be made to the claims herein for interpreting the scope of the invention.

DETAILED DESCRIPTION OF THE PREFERRED EMBODIMENT

Figure 1:
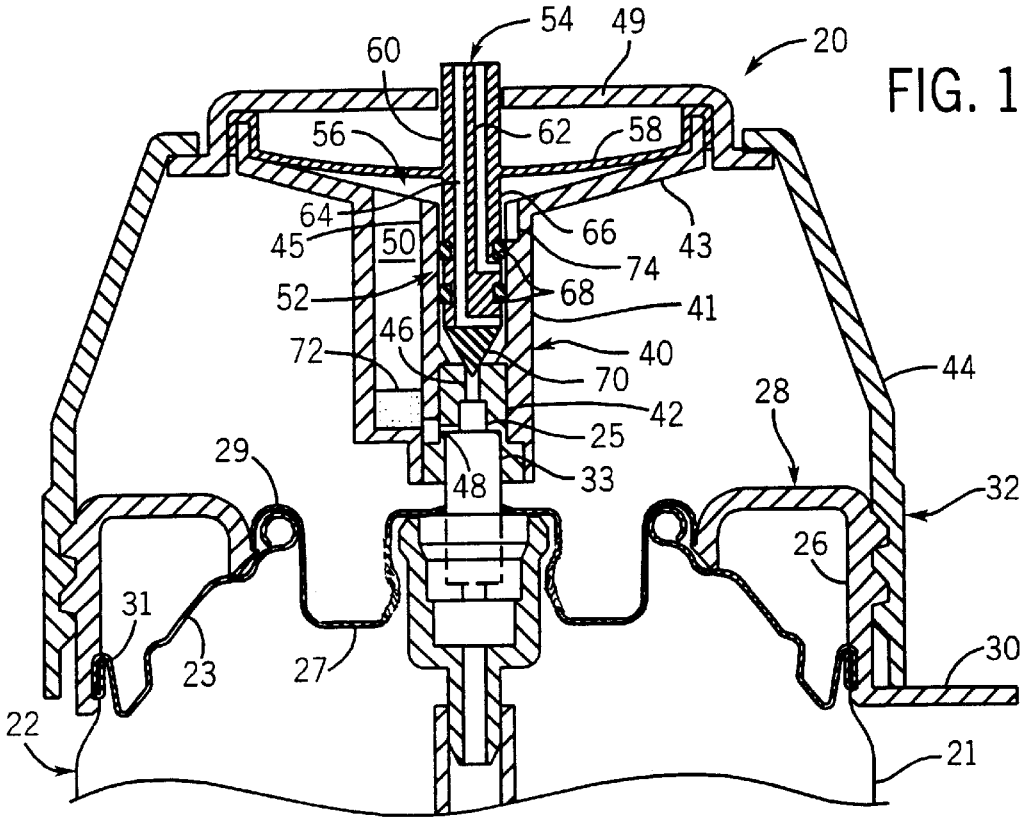
FIG. 1 is a sectional view of an automatic dispensing valve of the present invention in an "off" configuration, mounted onto an aerosol can.

Referring initially to FIG. 1, an aerosol can 22 includes a cylindrical wall 21 that is closed at its upper margin by the usual dome 23. The joint between the upper margin of the can wall 21 and the dome 23 is the can chime 31. An upwardly open cup 27 is located at the center of the dome 23 and is joined to the dome by a rim 29.

Conventional valve 33 is located at the center of the valve cup 27. The valve 33 has an upwardly extending valve stem 25, through which the contents of the can may be expelled. Valve 33 is shown as a vertically actuable valve, which can be opened by moving the valve stem 25 directly downwardly. Instead, one could use a side-tilt valve where the valve is actuated by tipping the valve stem laterally and somewhat downwardly.

A dispenser, generally 20, is configured for engagement with the vertically actuated type valve 33. The dispenser 20 is mostly polypropylene, albeit other suitable materials can be used.

The dispenser 20 includes a control assembly 32 having a side wall 44 that extends substantially axially upstream from a cover 49, and terminates with a threaded radially inner surface. It should be appreciated that throughout this description, the terms "axially outer, axially downstream, axially inner, axially upstream" are used with reference to the longitudinal axis of the container. The term "radial" refers to a direction outward or inward from that axis. Control assembly 32 further includes an inner mounting structure 28 having a pair of axially extending walls that engage the radially outer surfaces of rim 29 and chime 31 to fasten the structure 28 in place. The radially outer wall 26 of structure 28 has threads on its outer surface that engage the threads of side wall 44.

Figure 2:
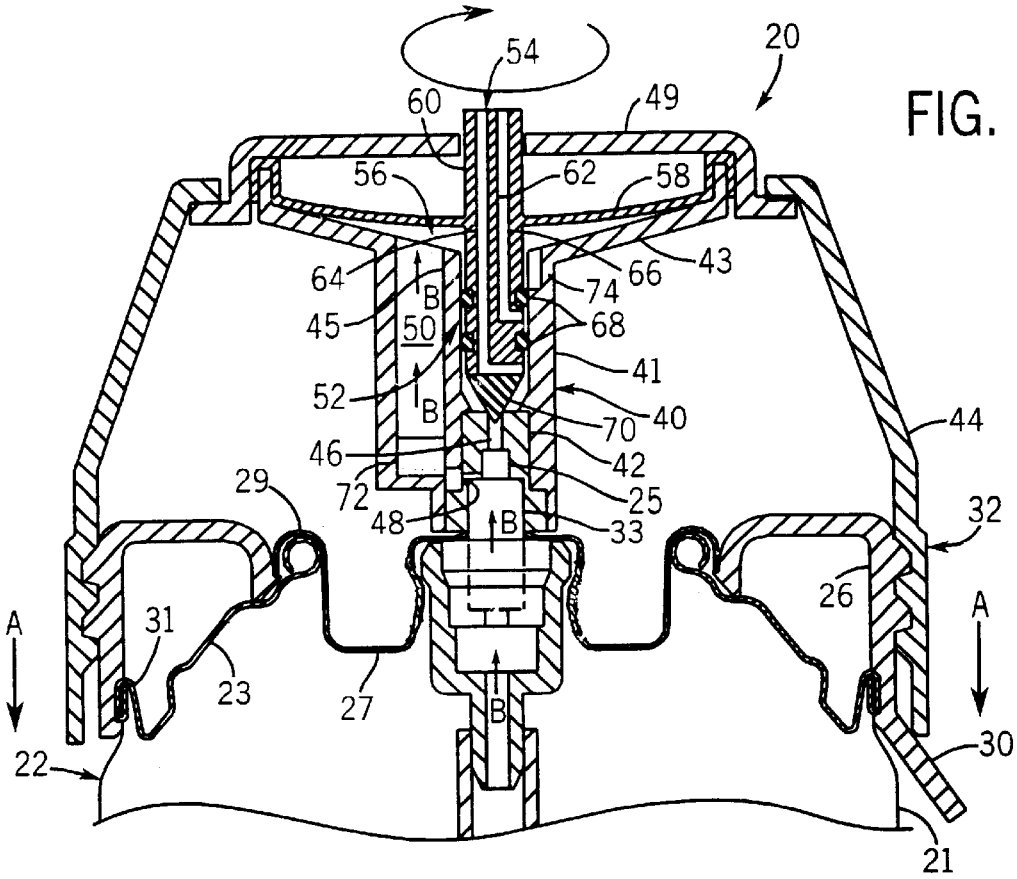
FIG. 2 is a view similar to FIG. 1, but with the valve in an "on" position.

The threads have a predetermined pitch such that as the assembly 32 is rotated clockwise with respect to the mounting structure 28, it is displaced axially along the downward direction of arrow A with respect to aerosol can 22, as illustrated in FIG. 2. In operation, therefore, a user rotates wall 44 to force the dispenser 20 downwardly along wall 26. Control assembly 32 may be further rotated to turn the dispenser 20 "ON" and "OFF," as will be described in more detail below.

Mounting structure 28 further includes a bar 30 that extends radially outwardly from the distal end of wall 26. Bar 30 is joined to wall 26 via a perforated tab (not shown) that is broken as the dispenser is mounted onto the can 22, thereby deflecting the tab 30 axially down to indicate that the dispenser 20 has been used at least once (e.g. tampered with on a retail shelf).

There is an annular retainer wall 40 having an axial component 41 that extends downstream from valve 33, and a radial component 43 that extends outwardly near the radially outer end of cover 49. An axially extending divider wall 45 is disposed within wall 40 to define a (i) centrally disposed void 52 that houses a valve assembly 54, and (ii) a conduit that allows aerosol content to flow from the can 22 to an accumulation chamber 56.

When the dispenser is initially mounted onto aerosol can 22, the bottom edge of wall 40 is located adjacent and radially aligned with the valve stem 25. However, it is not pressing down on stem 25.

When the valve 33 is not yet activated, the control assembly 32 has not yet engaged the aerosol can 22, and the assembly is in a storage/shipment position. However, as the control assembly 32 is rotated to displace the dispenser 20 downward in the direction of arrow A (see FIG. 2), the valve stem 25 is depressed, thereby allowing the aerosol content to flow from the can 22 into the dispenser 20.

Void 52 further houses, at its bottom, a valve actuator 42 that abuts the valve stem 25. Valve actuator 42 defines a centrally disposed first entry channel 46 that extends axially up from, and aligned with, valve stem 25. Actuator 42 further defines a second entry channel 48 that extends radially outwardly from valve stem 25 to an accumulation conduit 50. First and second entry channel 46 and 48 provide an outlet for the aerosol content during the spray phase of the accumulation cycle. Second entry channel 48 provides an outlet for aerosol content during the accumulation phase of the dispensing cycle.

Valve stem 25 includes two apertures (not shown) for expelling aerosol content into the dispenser. One aperture directs content axially outwardly from the valve 33 into the first entry channel 46. A second aperture extends radially outwardly and is aligned with second entry channel 48.

Accumulation chamber 56 is partially defined by a flexible, mono-stable diaphragm 58 that is movable between a first closed position (FIG. 3), and a second open position (FIG. 4) to activate the dispenser 20 at predetermined intervals. Diaphragm 58 is connected, at its radially outer end, to stationary wall 43. Diaphragm 58 is connected, at its radially inner end, to an axially extending annular wall 60 that is displaceable in the axial direction. A further divider wall 62 extends axially within wall 60, and defines a first path 64 that is linked to the can, and a second path 66 that can be linked to the accumulation chamber 56. A pair of o-rings 68 are disposed between the outer surface of wall 60 and the inner surface of wall 40. The axially inner end of wall 60 defines a plug 70 that is operable to block channel 46.

In operation, a consumer rotates the control assembly 32 relative to can 22, preferably by rotating wall 44. This causes the valve assembly 54 to become displaced axially downwardly, and biases wall 42 against valve stem 25. This causes the aerosol contents to begin to flow out of can 22. As is evident from FIG. 3, the aerosol contents will tend to flow both axially and radially out from valve stem 25. However, because plug 70 is blocking channel 46 at this point, all aerosol content is at first forced radially through channel 48 and into accumulation conduit 50 along the direction of Arrow B.

The mouth of conduit 50 is occupied by a porous gasket 72 that regulates the rate at which the aerosol contents are able to flow through the conduit. The constant supply of aerosol content causes pressure to build, and such pressure acts against the underside of diaphragm 58. A conduit 74 is provided at the axially outer end of axial portion 41 of wall 40. However, in the FIG. 3 configuration, the outer o-ring 68 prevents aerosol content from flowing from conduit 74 into path 66 and out the dispenser 20.

Figure 3:
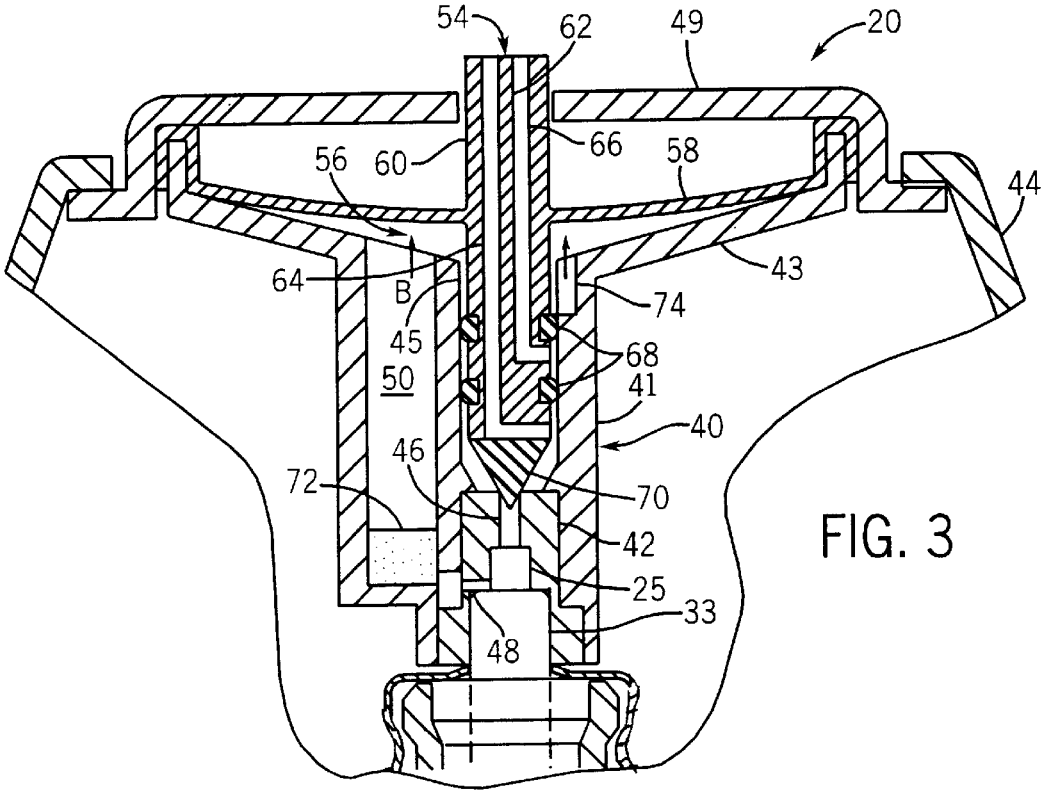
FIG. 3 is an enlarged view of a portion of the dispenser illustrated in FIG. 2.
Figure 4:
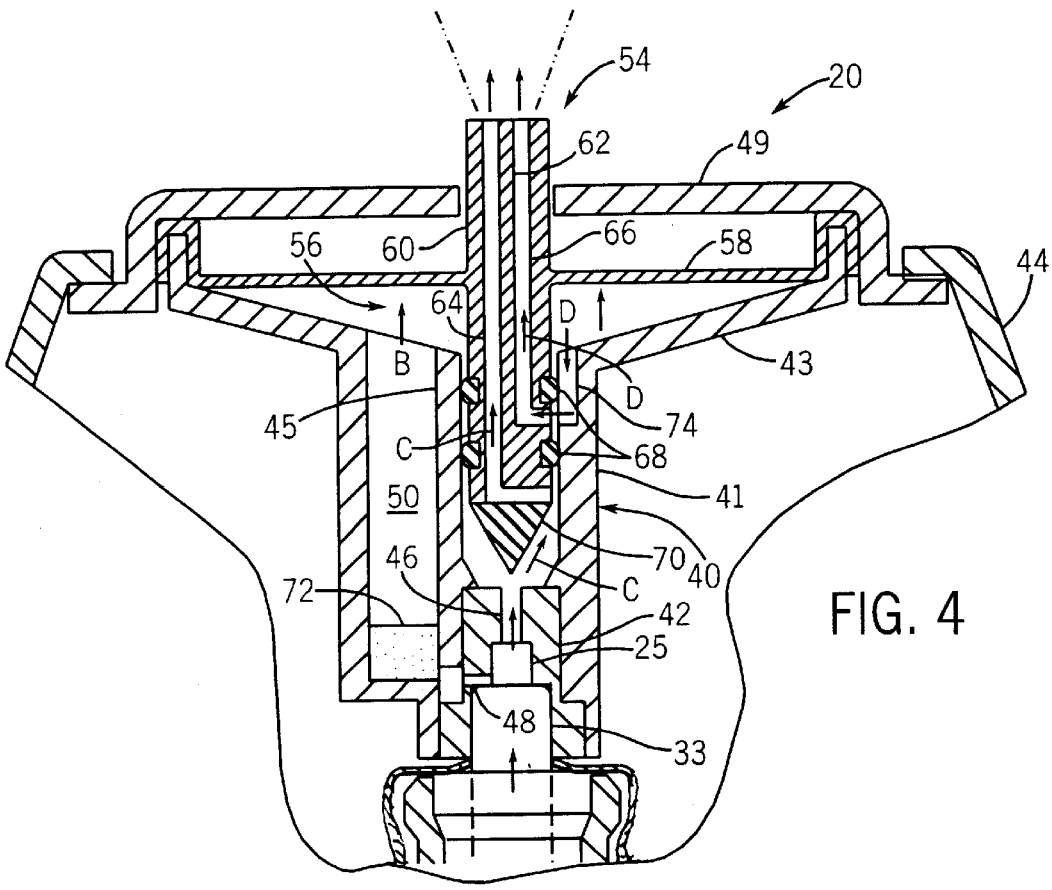
FIG. 4 is a view similar to FIG. 3, but with the valve in a spray configuration.

Once the accumulation chamber 56 is sufficiently charged with aerosol content, such that the pressure reaches a predetermined threshold, the mono-stable diaphragm 58 becomes deformed from the normal position illustrated in FIG. 3 to the position illustrated in FIG. 4. This initiates a spray phase.

As diaphragm 58 flexes up, wall 60 also is translated up, thereby removing the plug 70 from channel 46. Accordingly, aerosol content can flow up from valve stem 25, around plug 70, and into path 64 along the direction of Arrow C. The aerosol content exits dispenser 20 at the distal end of path 64 as a "puff".

In addition, as wall 60 is translated up, the inlet to path 66 becomes radially aligned with the mouth to conduit 74. Accordingly, accumulated aerosol content flows from accumulation chamber 56 and out the dispenser 20 through path 66 along the direction of Arrow D. Accumulated aerosol content thus exits the dispenser 20 as a separate stream from the aerosol content traveling from the can 20 during the spray phase. This has a particular advantage as the puff exiting from the can will not be subjected to back pressure from the accumulation chamber. This provides a more consistent spray each time.

Advantageously, the space between walls 41 and 60 are cleaned as the o-rings 68 are translated axially due to movement of the diaphragm 58. This further adds to the consistency of valve operation.

Aerosol content continues to flow from valve stem 25 through channel 48 and into accumulation chamber 56 during the spray phase. However, because more aerosol content is exiting the accumulation chamber 56 than that entering, the pressure within the chamber quickly abates. Once the pressure falls below a predetermined threshold, the diaphragm 58 snaps back to its normal position, re-establishing the seal between plug 70 and channel 46.

The accumulation phase is then once again initiated, such that all aerosol content flowing from can 22 into the dispenser 20 flows into accumulation chamber 56. The cycle is automatic and continuously periodic until the can contents are exhausted.

Figure 5:
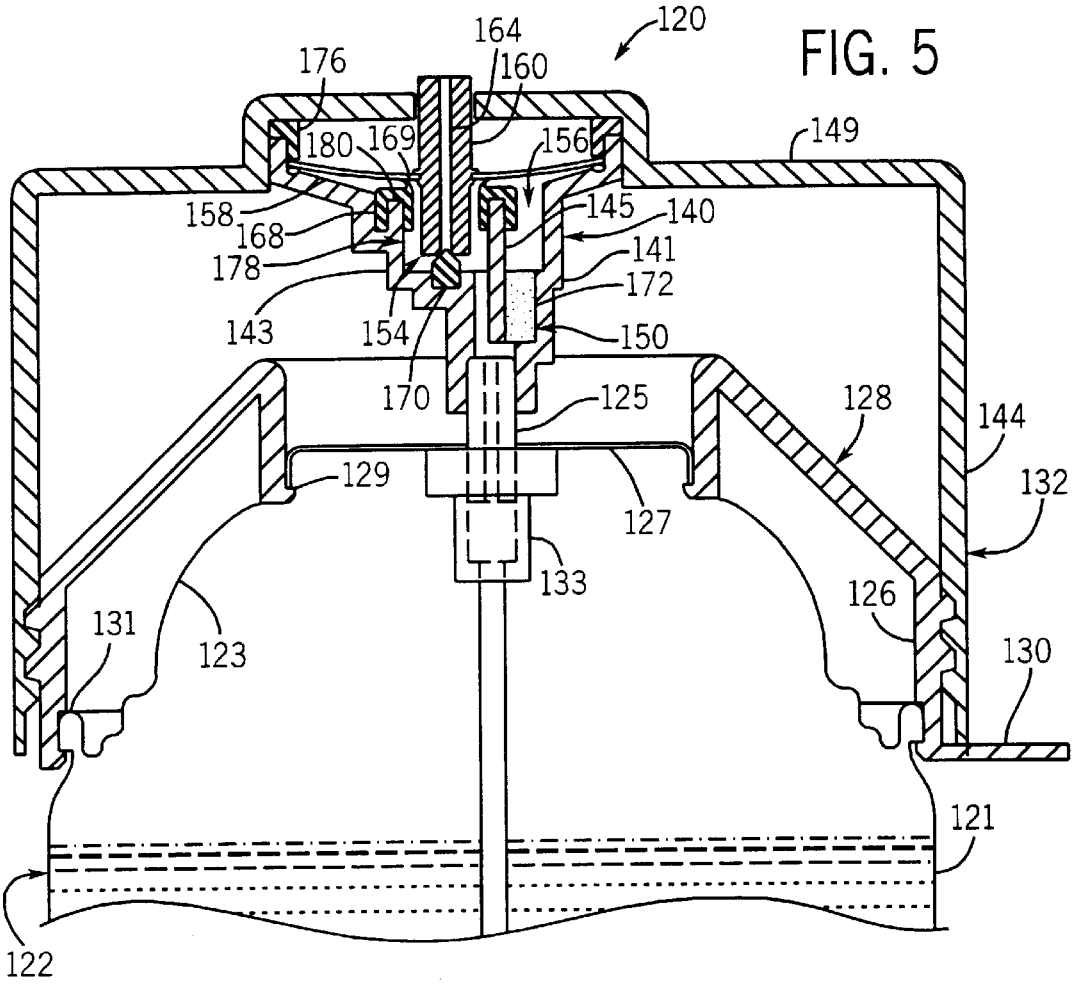
FIG. 5 is a view similar to FIG. 1, but of a second embodiment.
Figure 7:
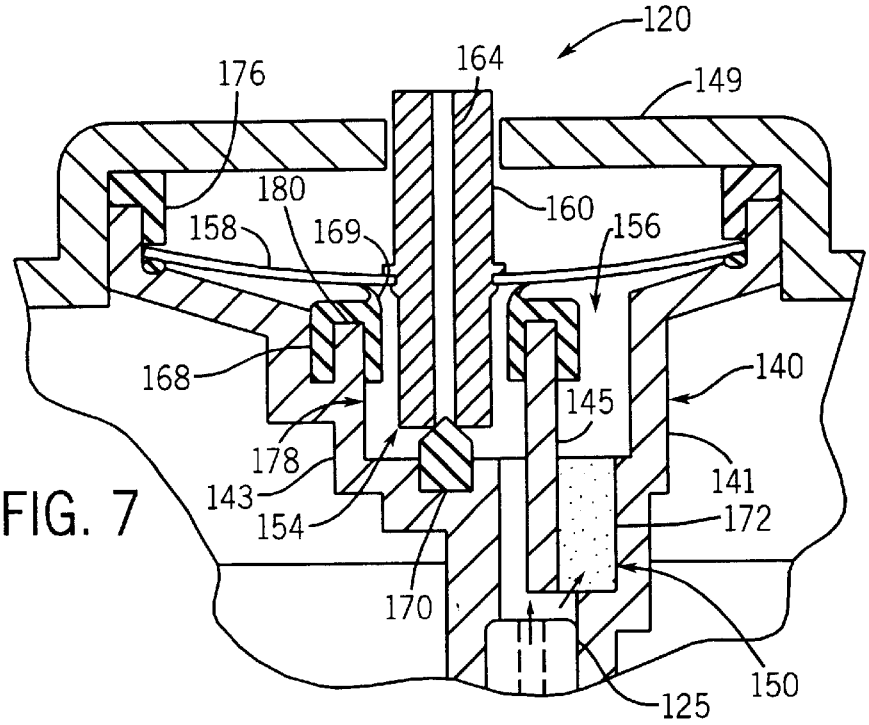
FIG. 7 is an enlarged view of a portion of the dispenser illustrated in FIG. 6.
Figure 6:
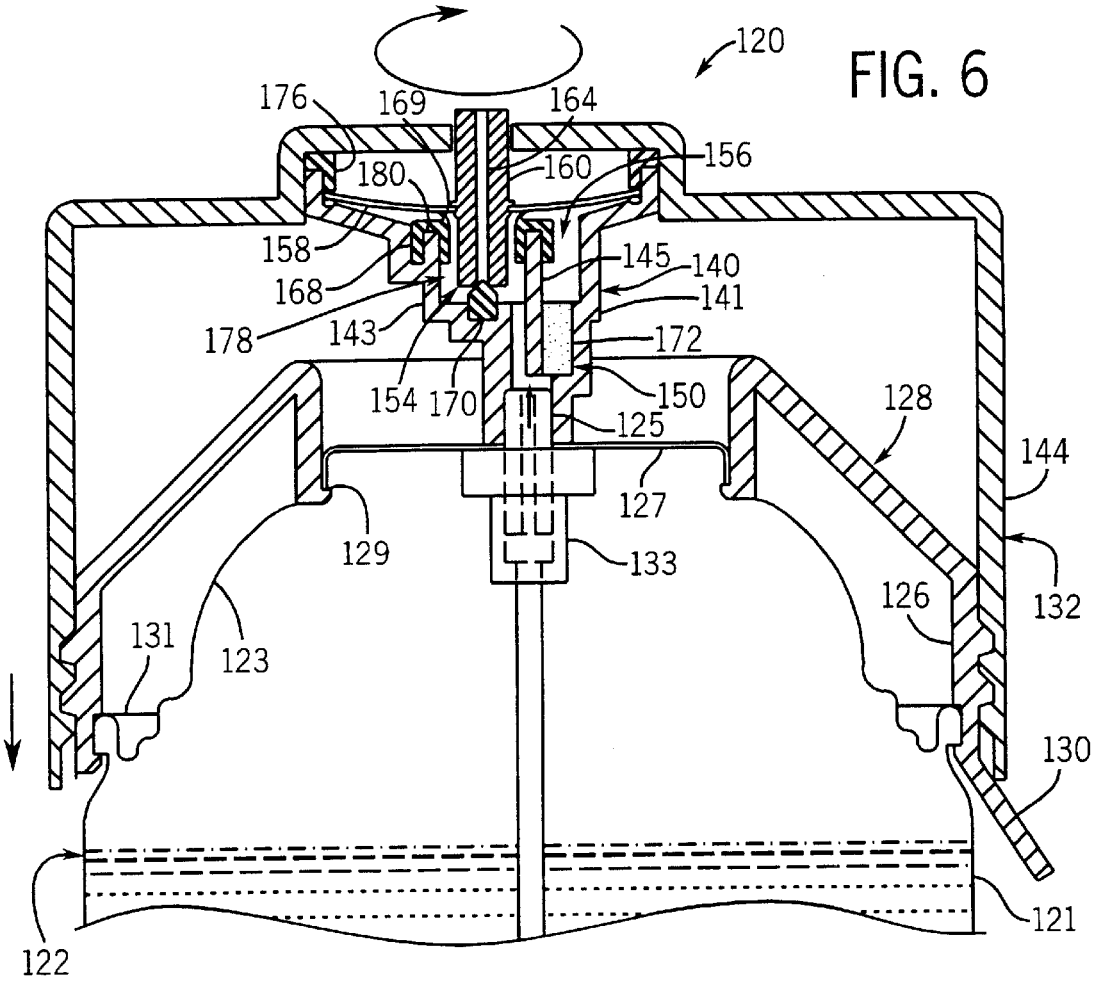
FIG. 6 is a view similar to FIG. 5, but with the valve in an "on" position.

Referring next to the FIG. 5 embodiment, a dispenser 120 is mounted onto an aerosol can 122 in accordance with an alternate embodiment of the invention, in which like reference numerals corresponding to like elements have been incremented by 100 for the purposes of clarity and convenience.

Dispenser 120 includes a side wall 144 that is integrally connected to cover 149. Side wall has a threaded inner surface that attaches to wall 126 in the manner described above. Valve assembly 154 includes an annular retainer wall 140 that extends outwardly from valve stem 125. A divider wall 145 extends axially within retainer 140 to define conduit 150 and a return path. Accumulated aerosol content merges with aerosol content that travels directly from the can out the dispenser during the spray phase, such that a single output spray is emitted.

Retainer wall 140 has an flange 180 that extends down and, in combination with the distal end of wall 145, supports a seal 168 having a flange 169 that engages the underside of diaphragm 158 to prevent aerosol content from escaping from the accumulation chamber 156 during the accumulation phase.

Figure 8:
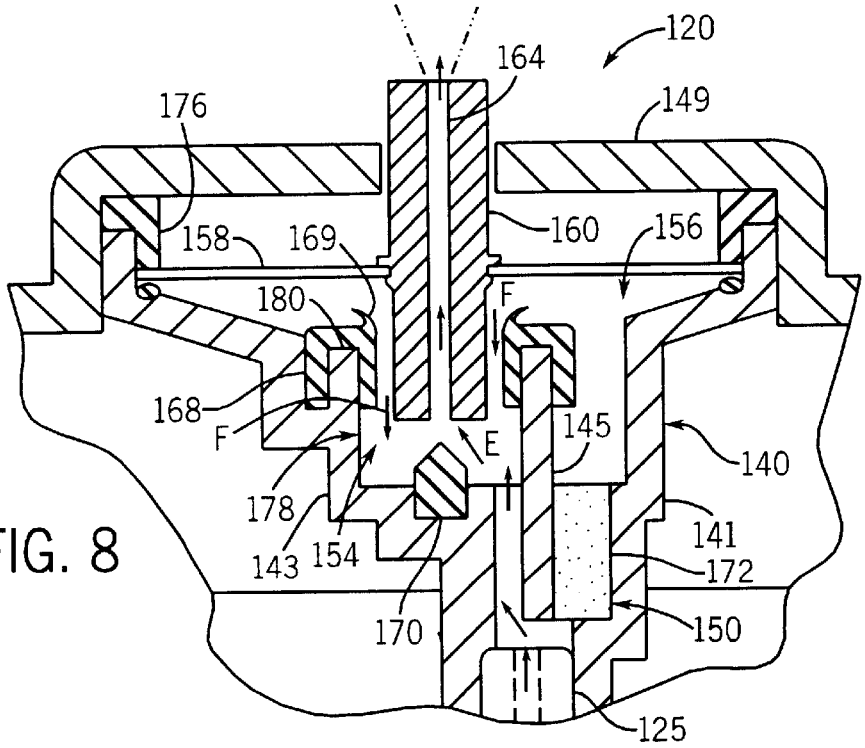
FIG. 8 is a view similar to FIG. 7, but with the valve in a spray configuration.

When the user rotates control assembly 132 relative to the can 122, the accumulation phase commences, where the axially inner end of retainer wall 140 is depressing valve stem 125 to begin the flow of aerosol content from the can 122 into the dispenser 120. Because plug 170 prevents the aerosol content from entering outlet 164, the content instead travels through the regulating porous media 172 and into the accumulation chamber 156. Once the pressure accumulating against the underside of diaphragm 158 reaches a predetermined threshold, the diaphragm deflects up, as illustrated in FIG. 8.

As the diaphragm 158 becomes deflected, wall 160 (which supports the radially inner edge of the diaphragm) is also translated up. The translation removes the interference between plug 170 and outlet 164, thereby permitting aerosol content to flow from the can 122, into outlet channel 164, and exit the dispenser 120 along the direction of Arrow E. Furthermore, the translation of wall 164 removes diaphragm 158 from flange 169, thus permitting accumulated aerosol content to travel to return 178 along the direction of Arrow F, and exit the dispenser 120 via outlet 164.

While aerosol content traveling into dispenser 120 from can 122 during the spray phase may also tend to travel into accumulation channel 150, it is appreciated that path 178 will likely provide less resistance to fluid flow than will the accumulation conduit 150 (due to gasket 172 and high pressure within accumulation chamber 156). Accordingly, the large majority of aerosol content flowing from can 122 during the spray phase will be immediately discharged via outlet 164. Once the pressure within accumulation chamber 156 abates below a predetermined threshold, diaphragm 158 snaps back to its normal position to begin another accumulation phase.

Figure 9:
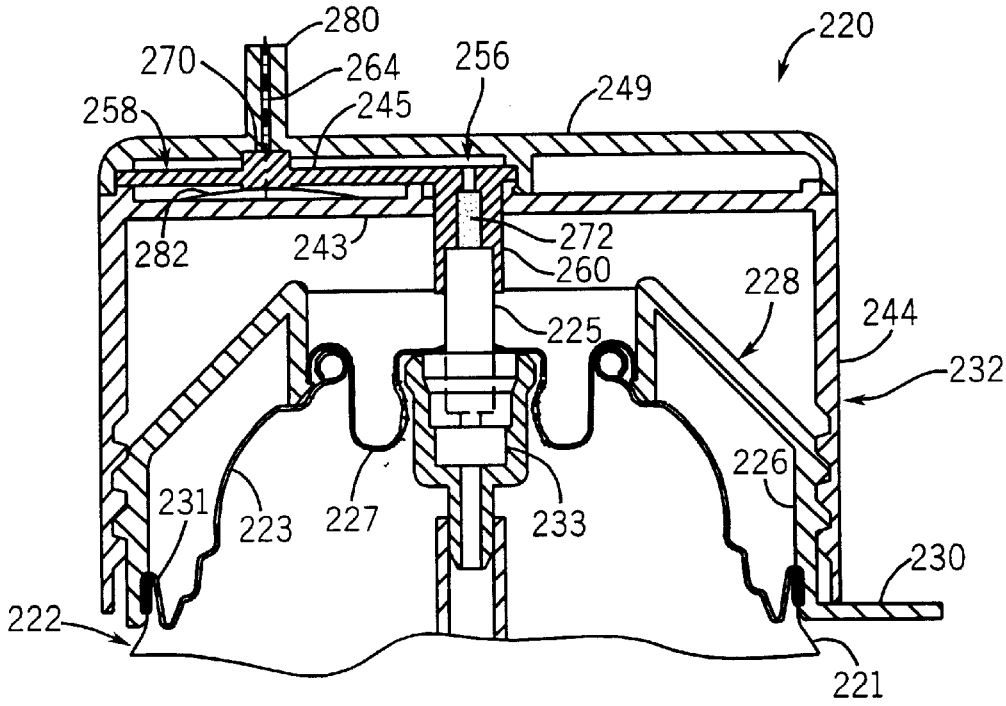
FIG. 9 is a view similar to FIG. 5, but of a third embodiment.
Figure 10:
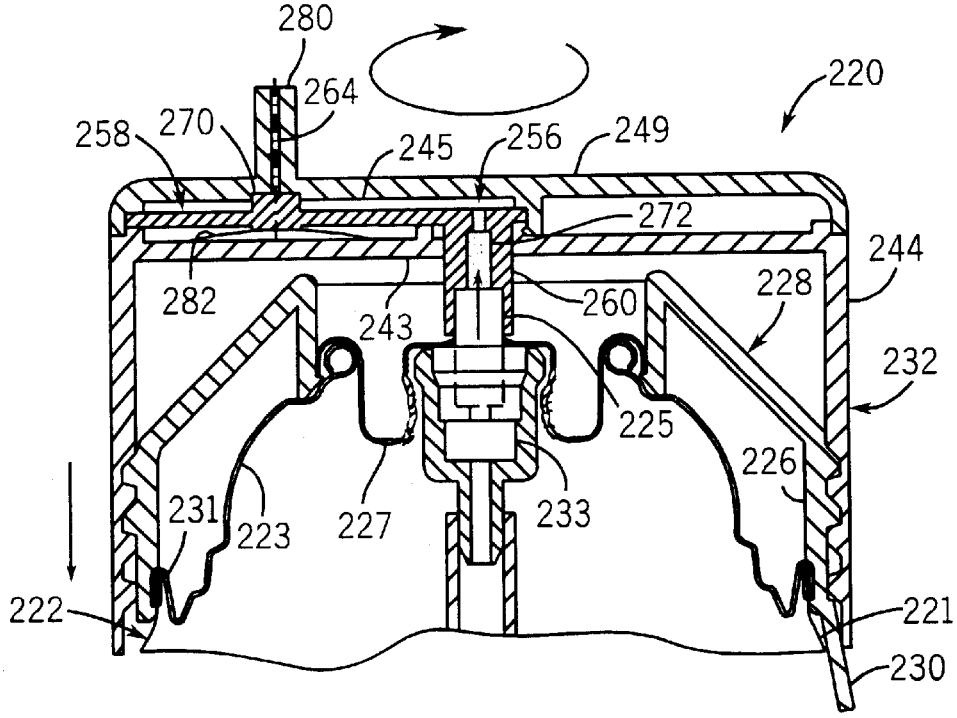
FIG. 10 is a view similar to FIG. 9, but with the valve in an "on" position.
Figure 11:
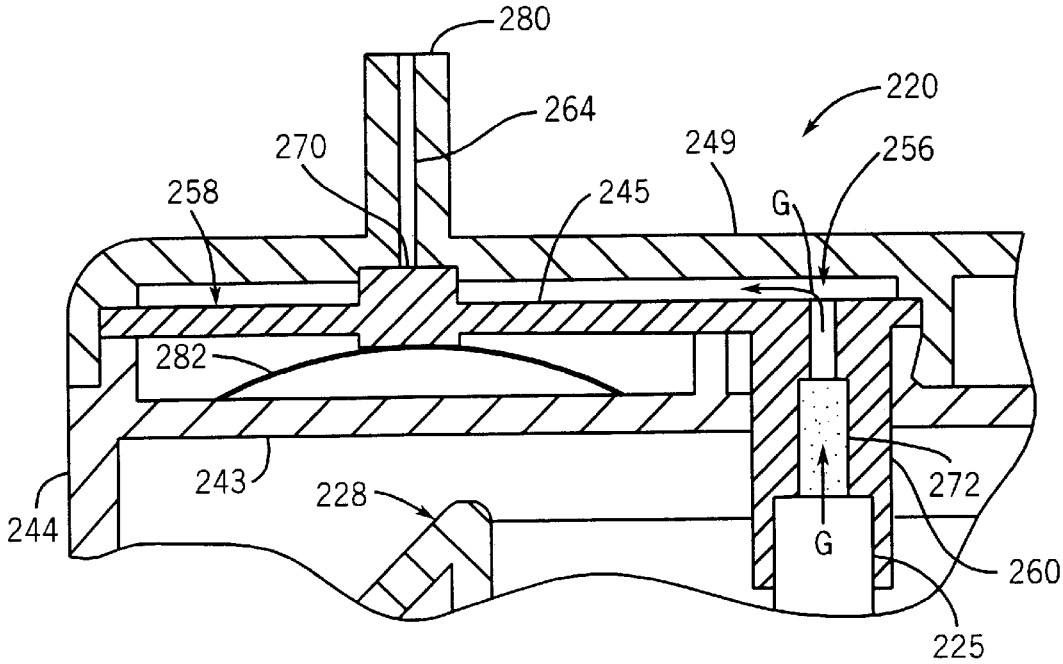
FIG. 11 is an enlarged view of a portion of the dispenser illustrated in FIG. 10.
Figure 12:
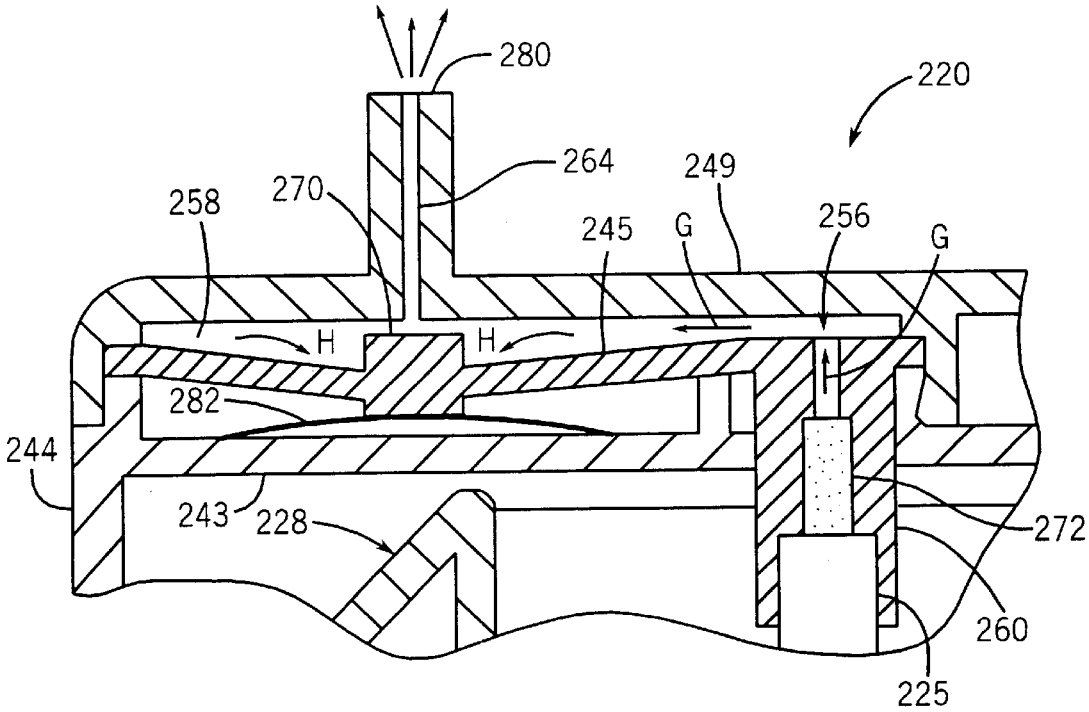
FIG. 12 is a view similar to FIG. 11, but with the valve in a spray configuration.

Referring next to FIG. 9, a third embodiment of the invention is illustrated having reference numerals corresponding to like elements of the previous embodiment incremented by 100 for the purposes of clarity and convenience. Dispenser 220 includes a side wall 244 having a threaded radially inner surface that meshes with threads on wall 226 of mounting structure 228 in the manner described above.

Wall 244 is integrally connected to a retainer wall 243 that extends radially inwardly there from. The radially inner edge of retainer wall 243 terminates at an annular accumulation conduit 260 that extends axially outwardly from valve stem 225. A porous media occupies the mouth of conduit 260. The axially outer end of conduit 260 is integrally connected to a flexible wall 245 that is secured at the interface between cover 249 and wall 244 at its radially outer end. An accumulation chamber 256 is thus defined by the existing void between the radially inner surface of cover 249 and the radially outer surface of wall 245.

Cover 249 defines a nozzle 280 defining an outlet path 264 that extends axially from the accumulation chamber 256 to the ambient environment. Wall 245 includes a plug 270 that is aligned with outlet 264. A spring 282 is seated at the axially outer surface of retainer 243, and biases wall 245 up under normal conditions such that plug occupies the mouth of outlet 264. Accordingly, the spring 282 and wall 245, in combination, in effect constitute a diaphragm unit 258.

When a user rotates dispenser 220 relative to can 222, conduit 260 is displaced down against valve stem 225 to initiate the flow of aerosol content. The aerosol content flows into accumulation chamber 256 via accumulation conduit 260 along the direction of Arrow G. The flow rate of aerosol content is regulated by gasket 272. As additional aerosol content flows into accumulation chamber 256, increasing pressure acts on the axially outer surface of flexible wall 245 as indicated by Arrow H.

Once the pressure within accumulation chamber 256 reaches a predetermined threshold, wall 245 flexes axially inwardly against the force of spring 282 such that plug 270 becomes removed from the mouth of outlet channel 264. The spray phase is thus initiated, whereby aerosol content flows from accumulation chamber 256 into the outlet channel 264, and out the dispenser 220 as a "puff." Because the aerosol content entering accumulation chamber 256 is regulated to have a flow rate less than the flow rate of accumulated aerosol content exiting the dispenser 220, the pressure within accumulation chamber 256 quickly abates below a threshold such that wall 245 snaps back to its normal position. Plug 270 once again blocks the outlet 264, and the accumulation phase again ensues.

It should thus be appreciated that accumulation chamber 256 also provides a conduit for aerosol content traveling from can 222, into dispenser 220, and out the nozzle 280. Otherwise stated, only accumulated aerosol content is permitted to exit dispenser 220.

Figure 13:
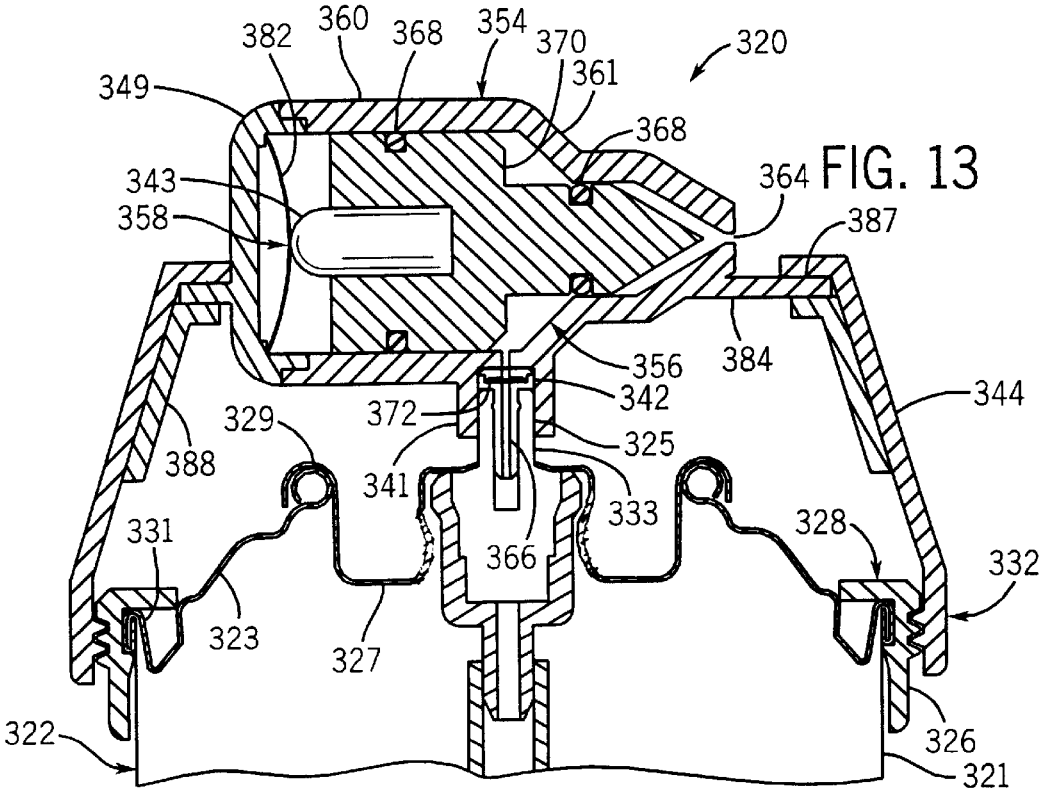
FIG. 13 is a view similar to FIG. 9, but of a fourth embodiment.

Referring now to FIG. 13, a fourth embodiment of the invention is illustrated having reference numerals corresponding to like elements of the previous embodiment incremented by 100 for the purposes of clarity and convenience. Dispenser 320 includes a side wall 344 having a threaded radially inner surface that meshes with threads on wall 226 of mounting structure 228, which is connected to can chime 331.

The inner surface of side wall 344 is attached to a second side wall 388 whose axially outer end defines a gap 387 with respect to the axially outer end of wall 344. Valve assembly 354 includes a radially extending annular wall 360 that defines an outlet 364 at one end, and is closed at the other end by an axially extending base 349. Outlet 364 extends laterally with respect to the can 322. The radially outer end of valve assembly 354 defines a flange 384 that is disposed within gap 387 to secure the valve assembly in place. An annular wall 341 extends axially inwardly from the axially inner end of wall 360, and houses an engagement wall 342, which abuts the outer surface of valve stem 325.

A piston 370 is disposed within valve assembly 354, and is slidable in the radial direction along the inner surface of wall 360. A pair of annular sealing rings is disposed at the interface between piston 370 and wall 360. Wall 360 presents a beveled surface 361 that, in combination with the outer surface of piston 370, defines an accumulation chamber 356 that is sealed with respect to outlet 364 via the outer o-ring 368. An annular wall extends axially upstream from wall 360, and engages valve stem 325. A conduit 366 extends through valve 333 and wall 341, and into accumulation chamber 356. A porous gasket 372 is disposed within conduit 366 to regulate the flow of aerosol content there through.

A spring member 358 extends axially within valve assembly 254, and is mounted to base 349. A plunger 343 extends radially out the inner end of piston 370 and abuts spring member 382. Spring 382 and plunger 343, in combination, define a diaphragm 358 assembly that normally biases the plunger outwardly so as to seal accumulation chamber 356 with respect to the outlet, thus preventing aerosol content from escaping from the dispenser 320.

Figure 14:
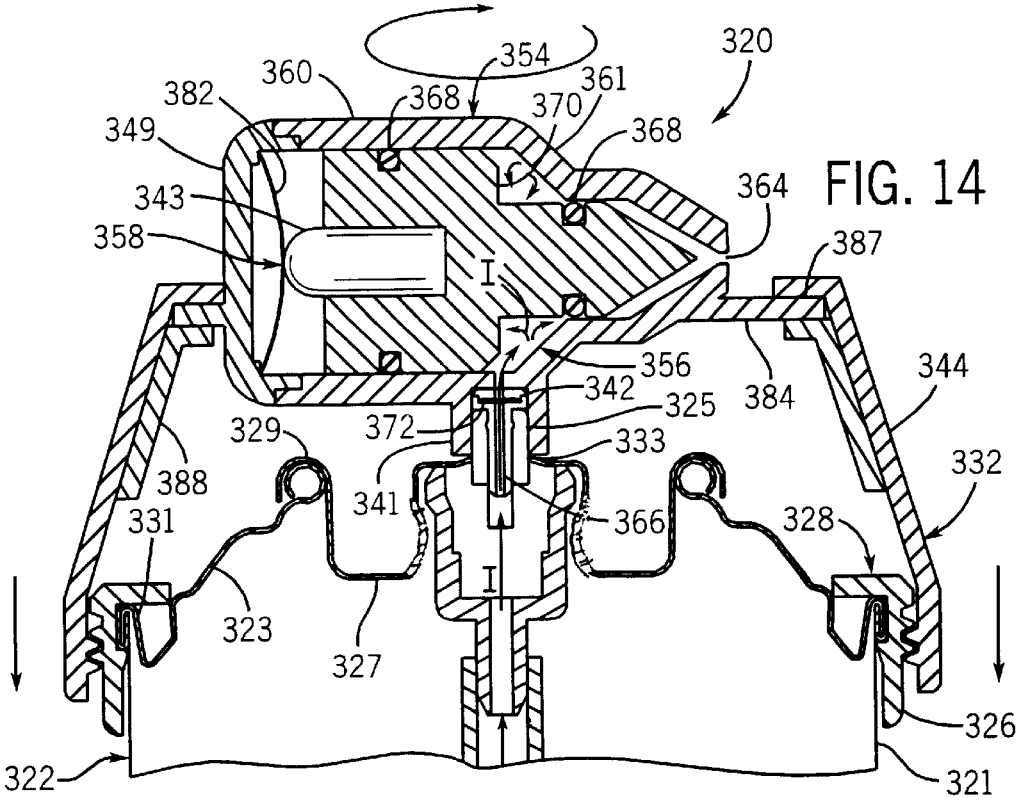
FIG. 14 is a view similar to FIG. 13, but with the valve in an "on" position.
Figure 15:
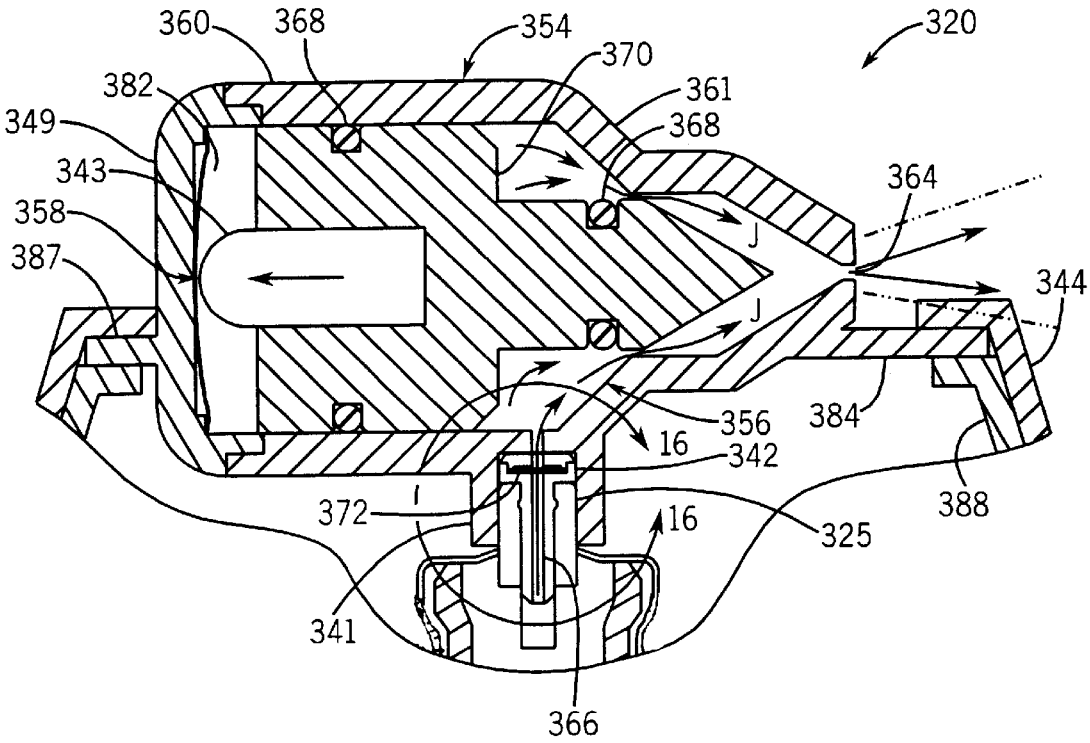
FIG. 15 is an enlarged view of a portion of the valve assembly of FIG. 13.
Figure 16:
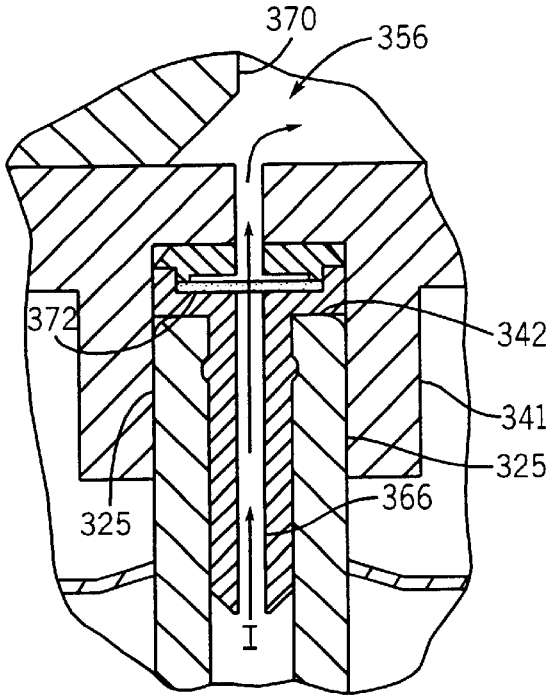
FIG. 16 is a further enlarged view of the valve of FIG. 15.

When a user rotates control assembly 332 to turn the dispenser "ON," the dispenser is biased axially upstream with respect to the can 322, as illustrated in FIG. 14. Referring also to FIG. 16, wall 341 depresses valve stem 325, and aerosol content begins flowing from can 322, through conduit 366, and into the annular accumulation chamber 356 as indicated by Arrow I. As aerosol content accumulates in chamber 356, the pressure acts against the piston 370. Once the pressure has exceeded a predetermined threshold, the piston is forced radially inwardly away from the outlet 364, and towards the base 349, against the force of spring 382, as illustrated in FIG. 15.

The seal is thus removed between the outer o-ring 368 and inner surface of wall 360 to allow aerosol content to travel from accumulation chamber 356 and out the outlet 364 along the direction of Arrow J. During the spray phase, aerosol content continues to flow from can 322 and into accumulation chamber 356 before being expelled from the dispenser. Because aerosol content is expelled from the dispenser at a greater rate than the aerosol content entering the accumulation chamber 356, the pressure within the chamber quickly abates. The spring 382 thus biases piston 370 to the closed position to begin the next accumulation cycle.

Figure 17:
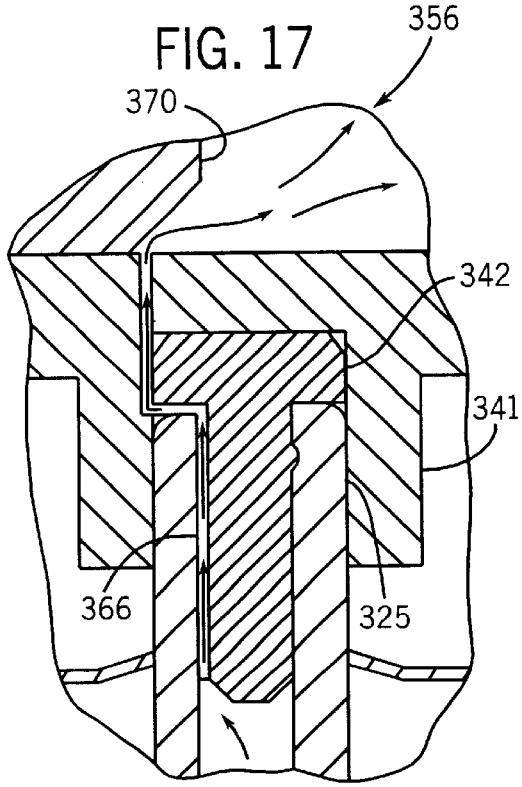
FIG. 17 is a view similar to FIG. 16, but in accordance with a further embodiment.

Referring now to FIG. 17, the fourth embodiment is presented without porous media 372. Instead, wall 342 is solid, and presents a gap 389 disposed between the outer surface of wall 342 and inner surface of valve stem 325 that extends along the inner surface of wall 341 into the accumulation chamber 356. The size of the gap regulates the flow of aerosol content into the accumulation chamber 356 during the accumulation and spray phases.

The above description has been that of preferred embodiments of the present invention. It will occur to those that practice the art, however, that many modifications may be made without departing from the spirit and scope of the invention. In order to advise the public of the various embodiments that may fall within the scope of the invention, the following claims are made.

INDUSTRIAL APPLICABILITY

The present invention provides automated dispenser assemblies for dispensing aerosol can contents without the use of electric power or manual activation.

We claim:

1. A dispenser that is suitable to dispense a chemical from an aerosol container, the dispenser being of the type that can automatically iterate between an accumulation phase where the chemical is received from the container, and a spray phase where the received chemical is automatically dispensed at intervals, the dispenser comprising:

a housing mountable on an aerosol container;

a movable diaphragm associated with the housing, the diaphragm being biased towards a first configuration;

an accumulation chamber inside the housing for providing variable pressure against the diaphragm; and valving operable in response to movement of the diaphragm for controlling flow of the chemical from the aerosol container to the accumulation chamber, and from the accumulation chamber out the dispenser;

whereby when the diaphragm is in the first configuration spray of the chemical out of the dispenser is prevented while flow of the chemical from the aerosol container to the accumulation chamber is permitted; and whereby when the pressure of chemical inside the accumulation chamber exceeds a specified threshold the diaphragm can move to a second configuration where chemical is permitted to spray from the dispenser.

2. The dispenser as recited in claim 1, wherein a first valve element is linked to the diaphragm to axially move therewith and control flow from the accumulation chamber out the dispenser via a first outlet path, and a second valve element is linked to the diaphragm to axially move therewith and control flow from the aerosol container out the dispenser via a second outlet path that is separate from the first.

3. The dispenser as recited in claim 1, wherein a first valve element is linked to the diaphragm to axially move therewith and control direct flow from the aerosol container out the dispenser via a first outlet path; and a second valve element is mounted adjacent the diaphragm to contact the diaphragm in the first configuration and not contact the diaphragm in the second configuration, the second valve element controlling flow from the accumulation chamber to the first outlet path.

4. The dispenser as recited in claim 1, wherein a first valve element is linked to the diaphragm to axially move therewith and control flow from the accumulation chamber out the dispenser via a first outlet path, and all chemical exiting the dispenser must pass through the accumulation chamber to exit the dispenser.

5. The dispenser as recited in claim 1, wherein a first valve element is linked to the diaphragm to move therewith and control flow from the accumulation chamber out the dispenser via an outlet path, and the chemical in the accumulation chamber exerts pressure against the diaphragm by exerting pressure against a transverse shuttle on which the first valve element is positioned.

6. The dispenser as recited in claim 1, wherein the diaphragm will shift back to the first configuration from the second configuration when pressure of the chemical in the accumulation chamber falls below a threshold amount.

7. The dispenser as recited in claim 1, further comprising such a container that is linked to the housing, and an actuator portion of the housing that rotates to allow chemical to be able to leave the container and enter the accumulation chamber.

8. The dispenser as recited in claim 1, wherein chemical flowing from the accumulation chamber merges with chemical flowing from the aerosol container prior to exiting the dispenser when the diaphragm is in the second configuration.

9. The dispenser as recited in claim 1, wherein chemical flowing from the accumulation chamber exits the dispenser as a separate stream from the chemical flowing directly out the dispenser from the aerosol container when the diaphragm is in the second configuration.

10. A method of automatically delivering a chemical from an aerosol container to an ambient environment at predetermined intervals, the method comprising the steps of:

(a) providing a dispenser suitable for use to dispense a chemical from the aerosol container, the valve assembly being of the type that can automatically iterate without the use of electrical power between an accumulation phase where the chemical is received from the container, and a spray phase where the received chemical is automatically dispensed at intervals, the valve assembly comprising:

(i) a housing mountable on an aerosol container;

(ii) a movable diaphragm associated with the housing, the diaphragm being biased towards a first configuration;

(iii) an accumulation chamber inside the housing for providing variable pressure against the diaphragm; and (iv) valving operable in response to movement of the diaphragm for controlling flow of the chemical from the aerosol container to the accumulation chamber, and from the accumulation chamber out the dispenser;

whereby when the diaphragm is in the first configuration spray of the chemical out of the dispenser is prevented while flow of the chemical from the aerosol container to the accumulation chamber is permitted; and whereby when the pressure of chemical inside the accumulation chamber exceeds a specified threshold the diaphragm can move to a second configuration where chemical is permitted to spray from the dispenser;

(b) mounting the dispenser to such an aerosol container; and (c) actuating the dispenser.

* * * * *